US009622927B1

(12) United States Patent
Edgerton

(10) Patent No.: US 9,622,927 B1
(45) Date of Patent: Apr. 18, 2017

(54) BED WITH EXTENDABLE AND RETRACTABLE EXTENSIONS

(71) Applicant: John Edgerton, Omro, WI (US)

(72) Inventor: John Edgerton, Omro, WI (US)

(73) Assignee: GF Health Products, Inc., Atlanta, GA (US)

( * ) Notice: Subject to any disclaimer, the term of this patent is extended or adjusted under 35 U.S.C. 154(b) by 91 days.

(21) Appl. No.: 14/046,708

(22) Filed: Oct. 4, 2013

Related U.S. Application Data

(60) Provisional application No. 61/710,599, filed on Oct. 5, 2012.

(51) Int. Cl.
*A61G 7/002* (2006.01)
*A61G 7/015* (2006.01)
*A47C 19/04* (2006.01)

(52) U.S. Cl.
CPC ..... *A61G 7/002* (2013.01); *A47C 19/04* (2013.01); *A61G 7/015* (2013.01)

(58) Field of Classification Search
CPC ..... A61G 7/015; A61G 7/018; A61G 7/002; A61G 13/08; A61G 13/02; A61G 13/00; A47C 19/04; A47C 17/58; A47C 17/52
USPC ... 5/600, 601, 613, 617, 618, 181, 183–185, 5/200.1, 201, 202, 285, 286
See application file for complete search history.

(56) References Cited

U.S. PATENT DOCUMENTS 4,669,136 A 6/1987 Waters et al.
5,179,744 A 1/1993 Foster et al.
5,377,370 A 1/1995 Foster et al.
6,357,065 B1 3/2002 Adams
7,406,729 B2 8/2008 Hornbach et al.
7,461,425 B2 * 12/2008 Chambers ..... A61G 7/0507 5/690
7,464,425 B2 * 12/2008 Chambers ..... A61G 7/05776 5/739
7,565,710 B2 * 7/2009 Chambers ..... A61G 7/0507 5/185
7,568,247 B2 * 8/2009 Strobel ..... A61G 7/05 5/613
7,676,862 B2 * 3/2010 Poulos ..... A61G 7/005 5/424
7,712,168 B2 * 5/2010 Kim ..... A61G 7/001 5/185
7,730,562 B2 * 6/2010 Hornbach ..... A47C 19/045 5/185
7,743,441 B2 * 6/2010 Poulos et al. ..... 5/618
(Continued)

*Primary Examiner* — Robert G Santos
(74) *Attorney, Agent, or Firm* — Brannen Law Office, LLC

(57) ABSTRACT

The present invention relates to bed with extendable and retractable extensions. An articulating bed having four sections that articulate in conventional manner is provided. Two side extensions are provided that allow the deck width to be increased in width. Each extension has four pieces that act in unison and that are pivotally connected. The pivotal connections can be made of tabs formed from the side tubes of the respective sections. The first and fourth pieces have extension members that extend into preferably about half way through cross tubes of the first and fourth respective deck sections. The extension members can have glides that assist in the movement within the cross tubes. Pins can be provided to allow for rapid adjustment of the side extensions. Accessories can be removably pinned to the side extension for rapid removal.

23 Claims, 11 Drawing Sheets

(56) References Cited

U.S. PATENT DOCUMENTS 7,757,318 B2 * 7/2010 Poulos ..... A61G 7/16 5/613
7,779,494 B2 * 8/2010 Poulos ..... A61G 7/005 5/618
7,805,782 B2 * 10/2010 Hakamiun ..... A61G 7/0507 5/428
7,845,032 B2 * 12/2010 Chambers ..... A61G 7/05776 5/600
7,845,034 B2 * 12/2010 Kim ..... A61G 7/015 5/608
7,882,581 B2 * 2/2011 Felix, Jr. ..... A47C 19/021 5/200.1
7,937,788 B2 * 5/2011 Felix ..... A47C 19/005 5/201
8,006,330 B2 * 8/2011 Lee ..... A47C 19/126 5/176.1
8,056,160 B2 * 11/2011 Poulos ..... A61G 7/005 5/424
8,056,163 B2 * 11/2011 Lemire ..... A61G 7/001 5/610
8,069,514 B2 * 12/2011 Poulos et al. ..... 5/618
D653,047 S 1/2012 Tekulve
8,104,122 B2 * 1/2012 Richards ..... A61G 7/05 5/600
8,220,086 B2 * 7/2012 Geiger ..... A47C 19/02 5/201
8,225,440 B2 * 7/2012 Lee ..... A47C 19/126 5/176.1
8,418,291 B2 * 4/2013 Hornbach ..... A61G 7/002 5/600
8,539,625 B2 * 9/2013 Poulos ..... A47C 19/04 5/600
8,856,987 B2 * 10/2014 Hornbach ..... A61G 7/002 5/600
8,997,282 B2 * 4/2015 Bossingham ..... A61G 7/002 5/600
9,009,888 B1 4/2015 Tekulve
9,119,753 B2 * 9/2015 Poulos ..... A61G 7/012
9,173,796 B2 * 11/2015 Rigsby ..... A61G 7/002
9,198,520 B2 * 12/2015 Goldsmith ..... A47C 19/005
9,358,169 B2 * 6/2016 Ottenweller ..... A61G 7/08
9,387,140 B2 * 7/2016 Tekulve ..... A61G 7/002
2003/0101513 A1 * 6/2003 Wong ..... 5/601
2006/0021142 A1 * 2/2006 Hornbach ..... A47C 19/045 5/600
2006/0021145 A1 * 2/2006 Hornbach ..... A61G 7/002 5/618
2006/0026762 A1 * 2/2006 Hornbach ..... A47C 19/045 5/611
2006/0026767 A1 * 2/2006 Chambers ..... A61G 7/0507 5/713
2006/0026768 A1 * 2/2006 Chambers ..... A61G 7/05776 5/713
2006/0053555 A1 * 3/2006 Poulos ..... A61G 7/005 5/618
2006/0053562 A1 * 3/2006 Poulos ..... A61G 7/16 5/722
2006/0059621 A1 * 3/2006 Poulos ..... A61G 7/005 5/430
2006/0059624 A1 * 3/2006 Poulos ..... A61G 7/002 5/618
2006/0168728 A1 * 8/2006 Strobel ..... A61G 7/05 5/618
2006/0195984 A1 * 9/2006 HakamiuN ..... A61G 7/0507 5/430
2006/0195986 A1 * 9/2006 Hakamiun ..... A61G 7/05 5/600
2007/0136949 A1 * 6/2007 Richards ..... A61G 7/05 5/600
2007/0151026 A1 * 7/2007 Felix ..... A47C 19/005 5/201
2007/0157388 A1 * 7/2007 Mossbeck et al. ..... 5/618
2008/0000028 A1 1/2008 Lemire et al.
2008/0005848 A1 * 1/2008 Chambers ..... A61G 7/0507 5/713
2008/0010752 A1 * 1/2008 Chambers ..... A61G 7/0507 5/706
2008/0168602 A1 * 7/2008 DiForio ..... 5/184
2008/0282472 A1 * 11/2008 Hornbach ..... A47C 19/045 5/616
2009/0070942 A1 * 3/2009 Chambers ..... A61G 7/05776 5/713
2009/0077744 A1 * 3/2009 Kim ..... A61G 7/001 5/202
2009/0077747 A1 * 3/2009 Kim ..... A61G 7/015 5/607
2009/0077748 A1 * 3/2009 Kim ..... 5/613
2009/0271925 A1 * 11/2009 Felix ..... A47C 19/005 5/201
2010/0005592 A1 * 1/2010 Poulos ..... A61G 7/012 5/618
2010/0107335 A1 * 5/2010 Poulos ..... A61G 7/005 5/430
2010/0115696 A1 * 5/2010 Felix, Jr. ..... A47C 19/024 5/201
2010/0154118 A1 * 6/2010 Pearce ..... A47C 19/021 5/201
2010/0205748 A1 * 8/2010 Koorey ..... 5/658
2010/0229303 A1 * 9/2010 Goldsmith ..... A47C 19/005 5/285
2010/0257672 A1 * 10/2010 Poulos ..... A61G 7/002 5/618
2010/0299831 A1 * 12/2010 Lee ..... A47C 19/126 5/202
2011/0247141 A1 * 10/2011 Poulos ..... A47C 19/04 5/658
2011/0289682 A1 * 12/2011 Lee ..... A47C 19/126 5/202
2012/0137430 A1 * 6/2012 Geiger ..... A47C 19/02 5/201
2013/0232690 A1 * 9/2013 Hornbach ..... A61G 7/002 5/614
2013/0298331 A1 * 11/2013 Bossingham et al. ..... 5/613
2014/0047641 A1 * 2/2014 Thodupunuri ..... A61G 7/002 5/613
2014/0215717 A1 * 8/2014 Rigsby ..... A61G 7/002 5/613
2015/0040313 A1 * 2/2015 Goldsmith ..... A47C 19/005 5/11
2015/0096815 A1 * 4/2015 Ottenweller ..... A61G 7/08 180/19.1
2015/0250323 A1 * 9/2015 Goldsmith ..... A47C 19/045 5/11
2015/0297430 A1 * 10/2015 Tekulve ..... A61G 7/002 5/202
2015/0297432 A1 * 10/2015 Poulos ..... A61G 5/14 5/610
2016/0038360 A1 * 2/2016 Rigsby ..... A61G 7/002 5/613
2016/0051058 A1 * 2/2016 Goldsmith ..... A47C 19/005 29/401.1
2016/0250090 A1 * 9/2016 Ottenweller ..... A61G 7/08 5/600

* cited by examiner

BED WITH EXTENDABLE AND RETRACTABLE EXTENSIONS

This U.S. utility patent application claims priority on and the benefit of provisional application 61/710,599 filed Oct. 5, 2012, the entire contents of which are hereby incorporated herein by reference.

BACKGROUND OF THE INVENTION

1. Field of the Invention

The present invention relates to bed with extendable and retractable extensions.

2. Description of the Related Art

It may be desirable for a bed to be designed that can be extended to accommodate the larger sizes needed in some situations.

Some examples include:

U.S. Pat. No. 4,669,136 to Waters et al. is titled Combination Hospital Bed and Surgical Table. This patent shows a combination hospital bed and surgical table. It is comprised of: a frame having floor-engaging wheels, a substantially flat, substantially rectangular deck carried by the frame, suitable for holding a human patient in the supine position, the deck having a head end and a foot end and being divided into at least three sections, including a lengthwise center section bordered by two, opposite, lengthwise, side sections that are hingedly connected to the frame so that they each can swing from a horizontal position down to an underneath position, below the center section, thereby making the deck narrower to facilitate its use as a surgical table, and means for holding the side sections in their horizontal position. Preferred additional features include means for raising and lowering the deck to different heights, a drop leaf head support segment, built-in weighing means, channels underneath the bed surface for X-ray cassettes, and an articulated bed surface to permit the bed to be converted into Trendelenburg, reverse Trendelenburg, or other positions, even a sitting position.

U.S. Pat. No. 5,179,744 to Foster et al. is titled Hospital Bed with Inflatable and Collapsible side Edges and Laterally-Movable Side Guards. It teaches a hospital bed that has a frame mounted on a base. Articulating head, seat and leg patient support panels are mounted on the frame. Side guards are mounted on the panels. Patient support panels have longitudinal edges that are collapsible to narrow the bed for transporting a patient. The side guards are inwardly movable to contribute to the narrowing of the bed while still protecting the patient from falling out of the bed.

U.S. Pat. No. 5,377,370 to Foster et al. is titled Hospital Bed with Collapsing Wing. It shows a collapsing wing on a lateral side near the head end of a hospital bed. As the result of a laterally inwardly applied force, the wing collapses thereby allowing easier access to the center or furthermost side of the hospital bed or patient for a nurse or care provider. The wing is attached to the bed frame of the hospital bed by a spring loaded parallelogram linkage which permits the wing to move laterally within a generally horizontal plane as a result of the inward force. Once the inward force is removed, the linkage returns the wing to the full width hospital bed configuration. The wing is a U-shaped channel open toward the bed. The bed has a narrower U-shaped channel open toward the wing channel. The channels are connected by the parallelogram linkage. The wing channel nests over the frame channel when a laterally inward force is applied to the wing channel.

U.S. Pat. No. 7,406,729 to Hornbach et al. is titled Patient Support having Powered Adjustable Width. It shows a patient support for supporting a patient in a horizontal position is provided. The patient support includes a frame and a deck. The deck includes first and second ends and longitudinal sides extending there between. The deck also includes a first portion configured to extend laterally from the deck to widen the deck. An actuator is coupled to the deck and configured to move the first portion between an extended position and a retracted position.

U.S. Pat. No. 7,743,441 to Poulos et al. is titled expandable Width Bed. It shows a variable width bed is provided. In one embodiment the bed has a frame, a deck supported on the frame, and a mattress on the deck. A portion of the mattress on one of head and seat deck sections expands to have an increased width. In an alternate embodiment, deck extender assemblies are provided at the sides of the bed. Each of the deck extender assemblies have supplemental mattresses connected thereto.

United States Published Application 2008/0000028 to Lemire et al. is titled Patient Support. It shows a patient support apparatus, such as a bed, stretcher, or cot, includes a patient support deck that is directly coupled to elevation adjustment mechanisms without the need for an intervening frame. The elevation adjustment mechanisms may be placed outside the perimeter of the support deck to allow the support deck to be lowered to a greater extent and provide room for attaching side rails to the support deck. The width of the patient support deck may be adjusted by way of extenders, and the sleep surface may also be adjusted by way of foldable strips. A jack type of actuator may be used to pivot the different sections of the support deck with respect to each other. The elevation adjustment mechanisms may include vertical threaded shafts that rotatingly engage threaded collars and raise or lower the collars when the shaft and the collar rotate with respect to each other.

While each of these references show inventions that may work well for their intended purposes, none show the unique features having the advantages of the present invention.

Thus there exists a need for a bed with extendable and retractable sections that solves these and other problems.

SUMMARY OF THE INVENTION

The present invention relates to bed with extendable and retractable extensions. An articulating bed having four sections that articulate in conventional manner is provided. Two side extensions are provided that allow the deck width to be increased in width. Each extension has up to four pieces that act in unison and that are pivotally connected. The pivotal connections can be made of tabs formed from the side tubes of the respective sections. The first and fourth pieces have extension members that extend into preferably about half way through cross tubes of the first and fourth respective deck sections. The extension members can have glides that assist in the movement within the cross tubes. Pins can be provided to allow for rapid adjustment of the side extensions. Accessories can be removably pinned to the side extension for rapid removal.

According to one advantage of the present invention, the extension members are moveable within cross-tubes of the deck. This allows for the side extension pieces to remain generally parallel to each other and generally perpendicular to the cross tubes. Maintaining this orientation prevents binding of the side extensions as the bed is articulated.

According to another advantage of the present invention, the side extensions telescopingly connect to the deck via the inside of the respective structural member. In this regard, any vertical load experienced by the deck is isolated from and has no effect on the inward and or outward movement of extensions.

Related, and according to another advantage of the present invention, the extension member contacts both the top and bottom of the cross tube (directly or via glide) to provide a strength to resist twisting of the side extensions. In a preferred embodiment, the extension member is generally square which provides for structural support of the extension member to resist twisting and bending.

Related, and according to a still further advantage of the present invention, the extension members can extend in the preferred embodiment to nearly the middle section of the cross-tube. This provides a large amount of stiffness to the side extensions to prevent twisting thereof.

According to a still further advantage yet of the present invention, glides can be provided to reduce friction between the extension member and the cross tubes. The glides can be low friction material which can slide, roll or otherwise encourage easy movement of these components.

According to a still further advantage of the present invention, in one embodiment, the extension members of opposite sides extensions can be joined in a manner wherein movement of one side extension is mirrored by the opposite side extension simultaneously.

According to a still further yet advantage of the present invention, the side extensions can be unlocked for adjustment from the underside of the deck. In this regard, advantageously, any weight on the deck or other obstructions from above the deck surface will not encumber the ability to quickly adjust the side extensions (for example, to move the bed through a narrow door frame).

According to a still further advantage of the present invention, the side perimeters of the side extensions are substantially tubular along the length. This provides strength to the side extensions that allow for accessories to be adequately supported.

According to a still further advantage yet of the present invention, an accessory, such as a side rail, can be supported by a strong tube when connected to the extensions yet easily removable form the side extension preferably by removing one or more pins. In this regard, the accessory is removable independent of extensions and without tools.

According to a still further advantage of the present invention, the individual pieces of each side extension are joined together with one or more tabs. The tab is preferably formed from the outside wall of the tubular side members wherein the remainder (top, bottom and inside surface) are removed. This allows the side extension to act as an assembly.

According to a still further advantage of the present invention, the principles of the invention can be applied to a longitudinally expanding and retracting deck as well.

Other advantages, benefits, and features of the present invention will become apparent to those skilled in the art upon reading the detailed description of the invention and studying the drawings.

DETAILED DESCRIPTION OF PREFERRED EMBODIMENTS

Figure 1:
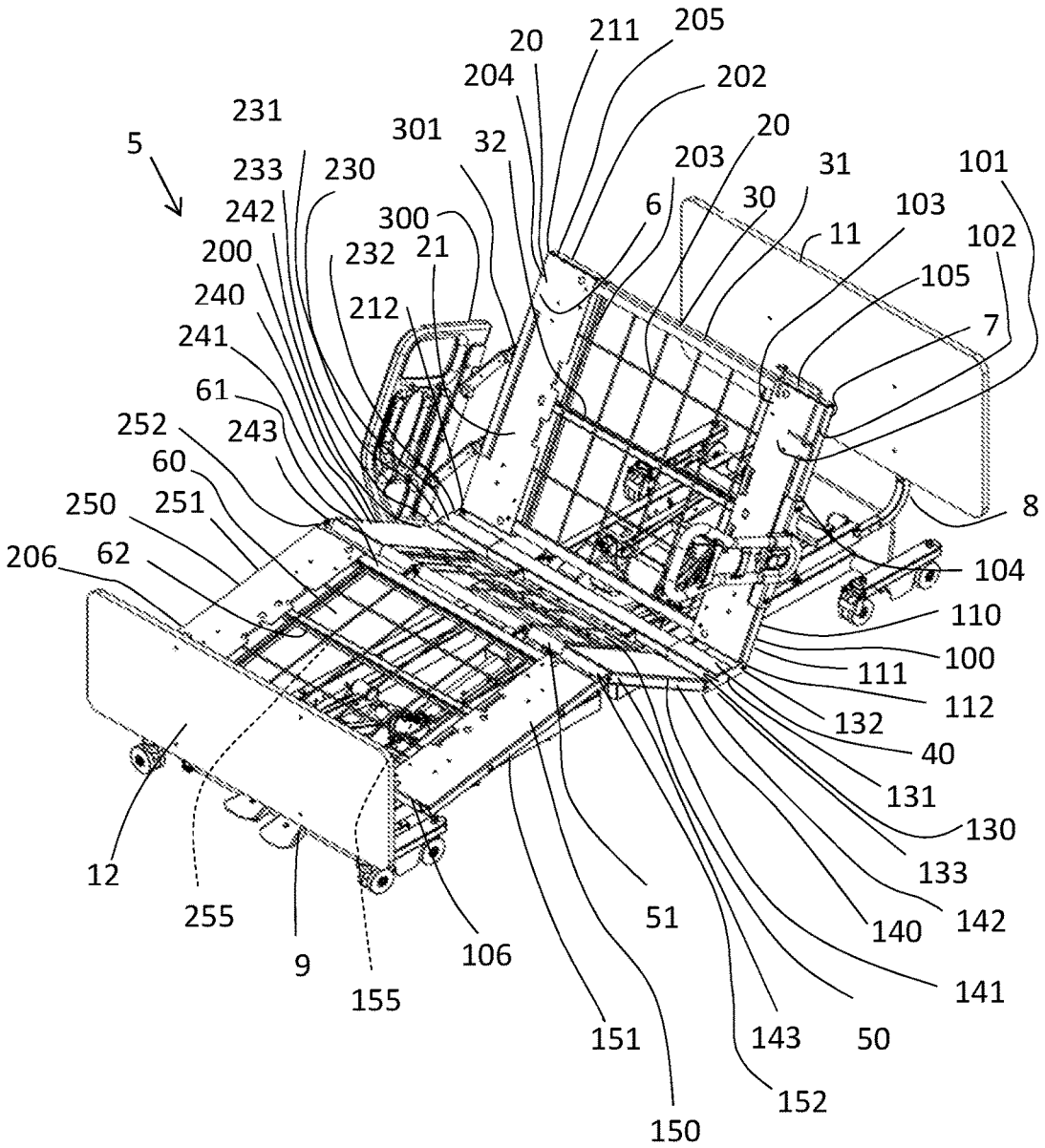
FIG. 1 is a perspective view of a bed articulated to an upright position.
Figure 2:
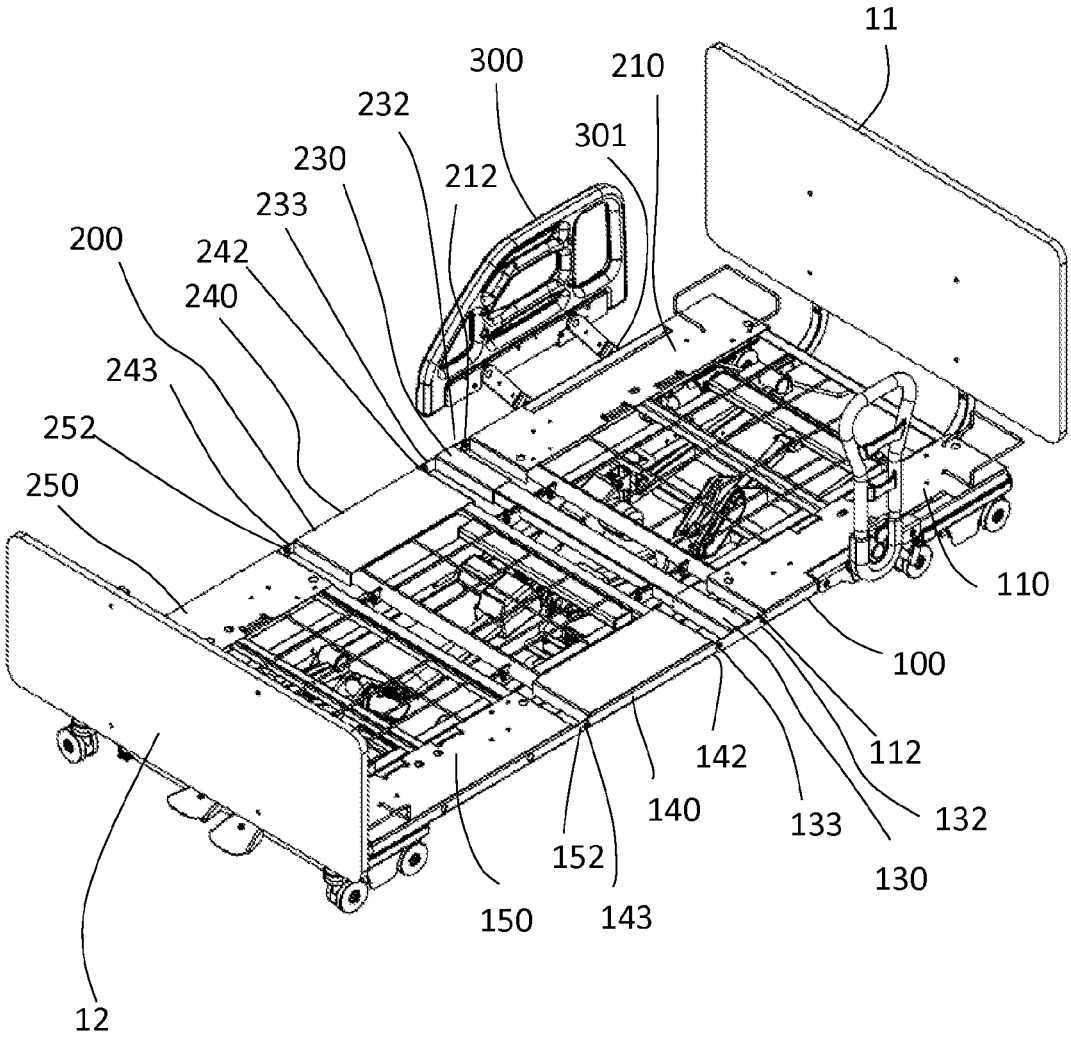
FIG. 2 is a perspective view showing the deck in a flat position and the side extensions in a retracted position.
Figure 3:
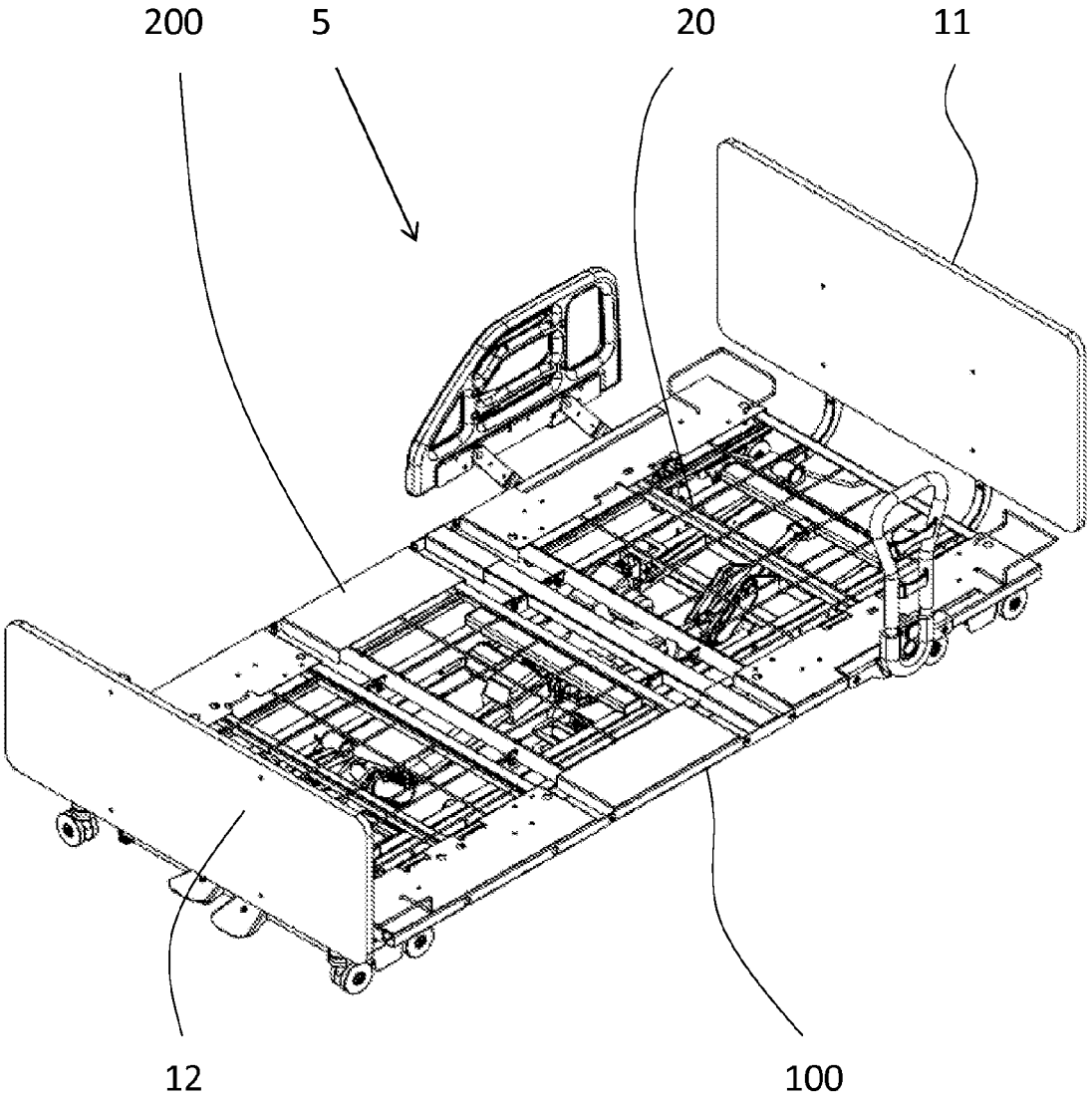
FIG. 3 is similar to FIG. 2 but shows the side extensions in an intermediate position.
Figure 4:
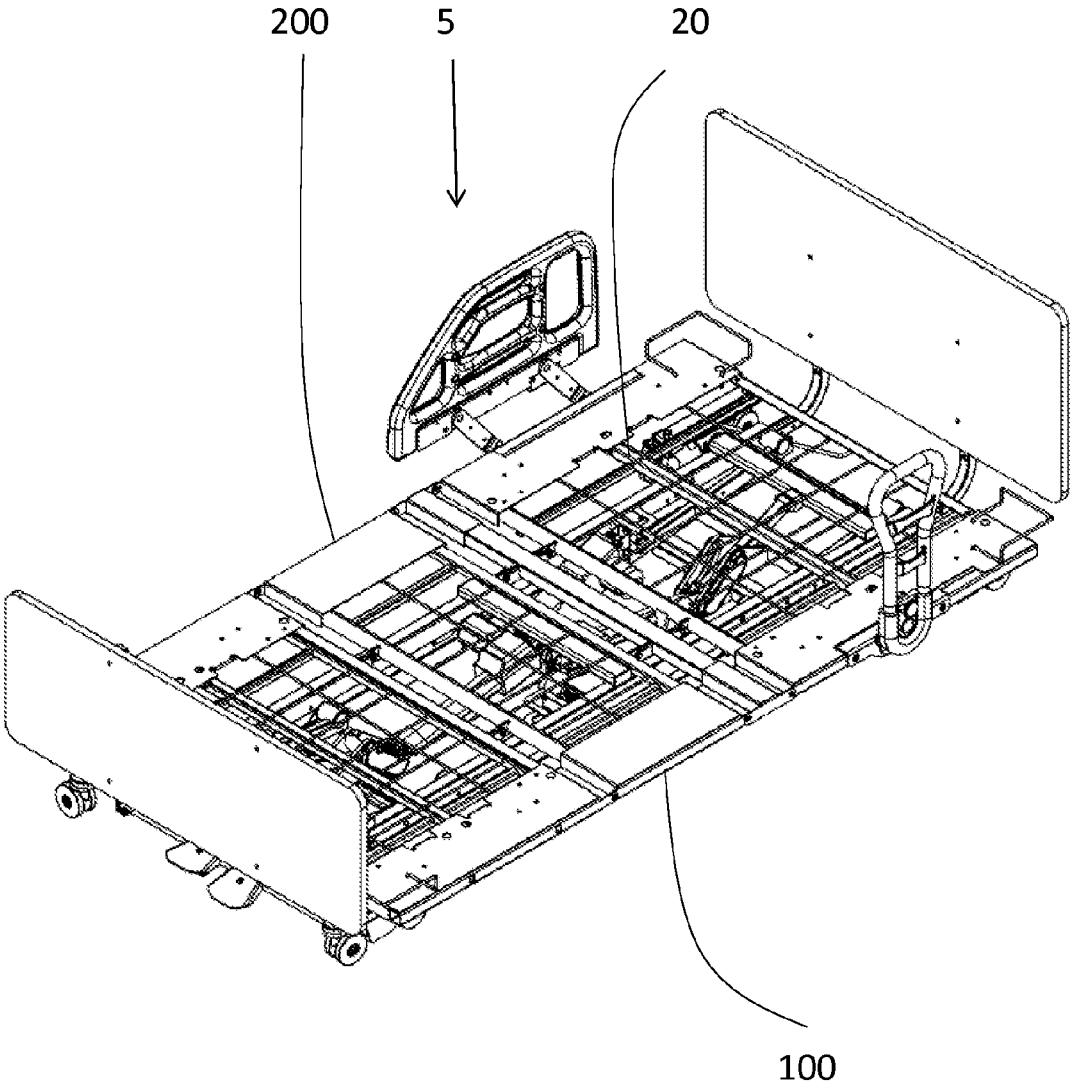
FIG. 4 is similar to FIG. 2 but shows the side extensions in an extended position.
Figure 5:
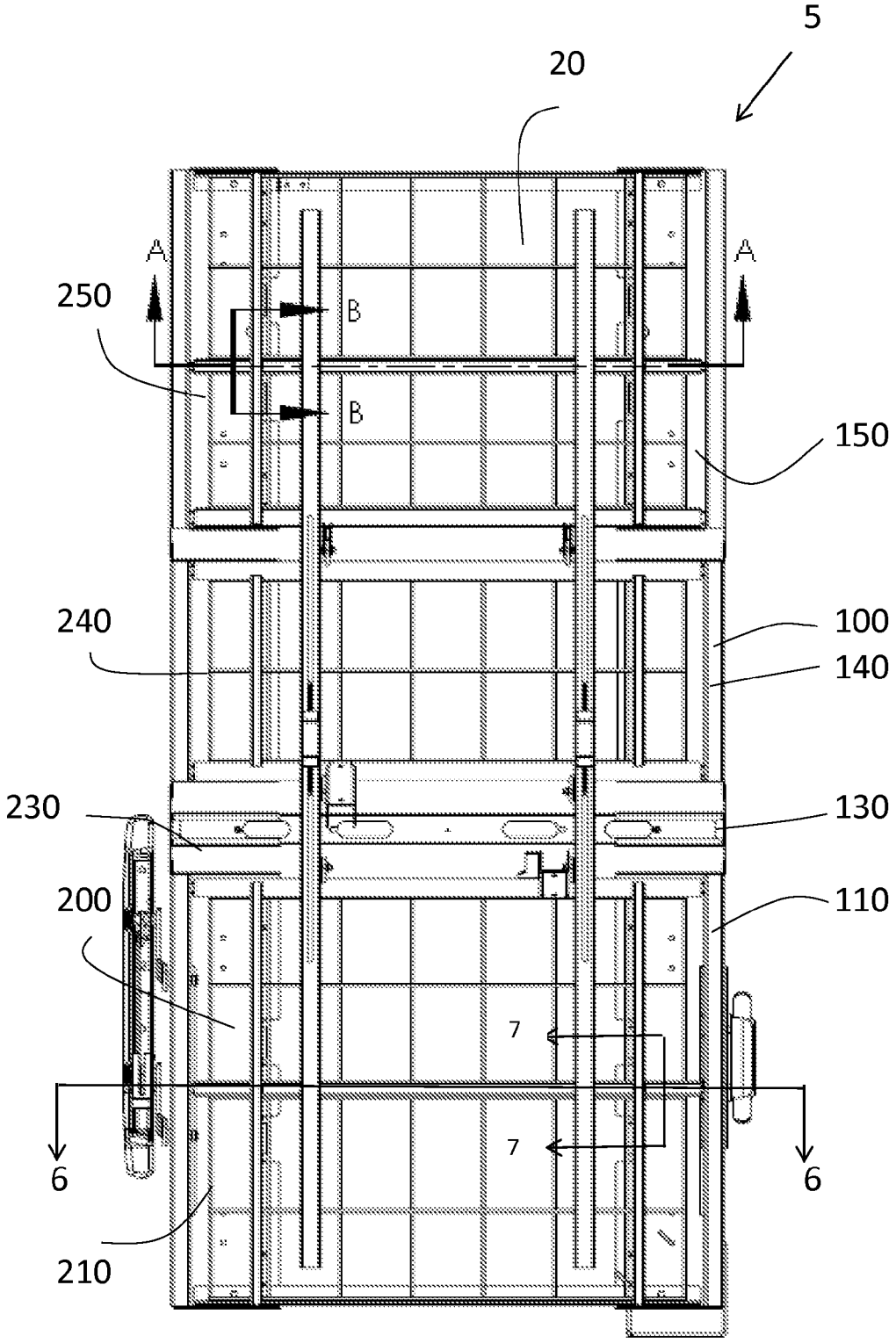
FIG. 5 is a top view of the present invention.
Figure 6:
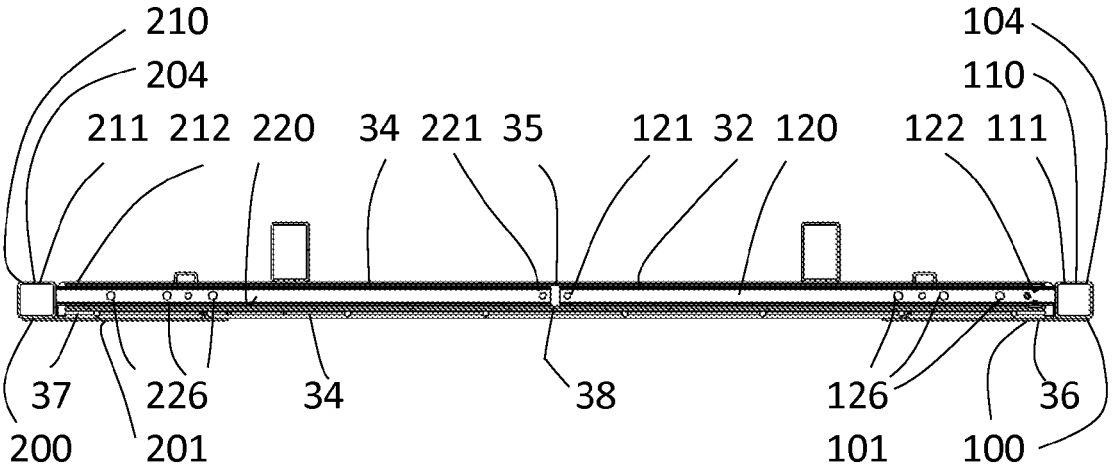
FIG. 6 is a cross-sectional view taken along line 6-6 in FIG. 5.
Figure 7:
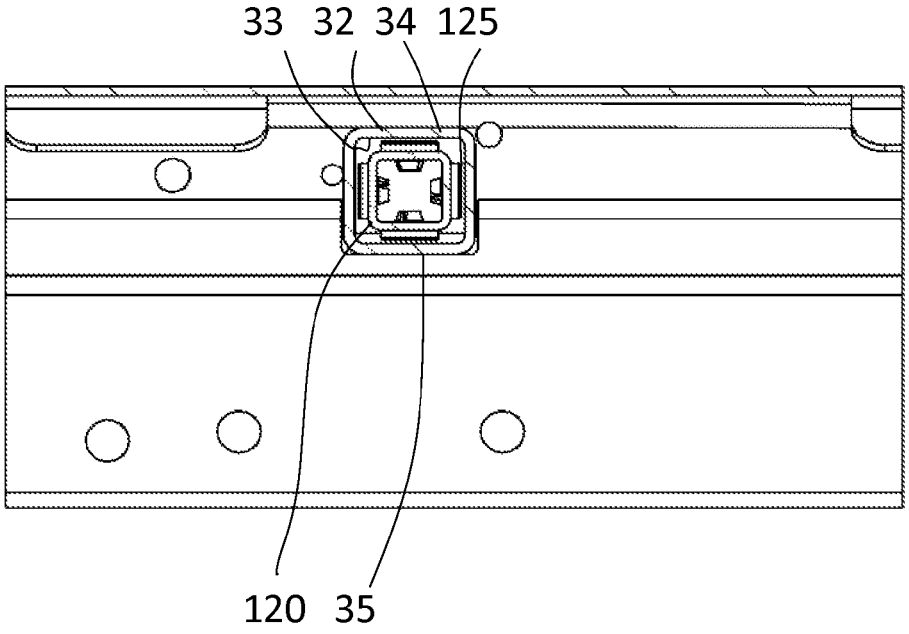
FIG. 7 is a cross-sectional view taken along line 7-7 in FIG. 5.
Figure 8:
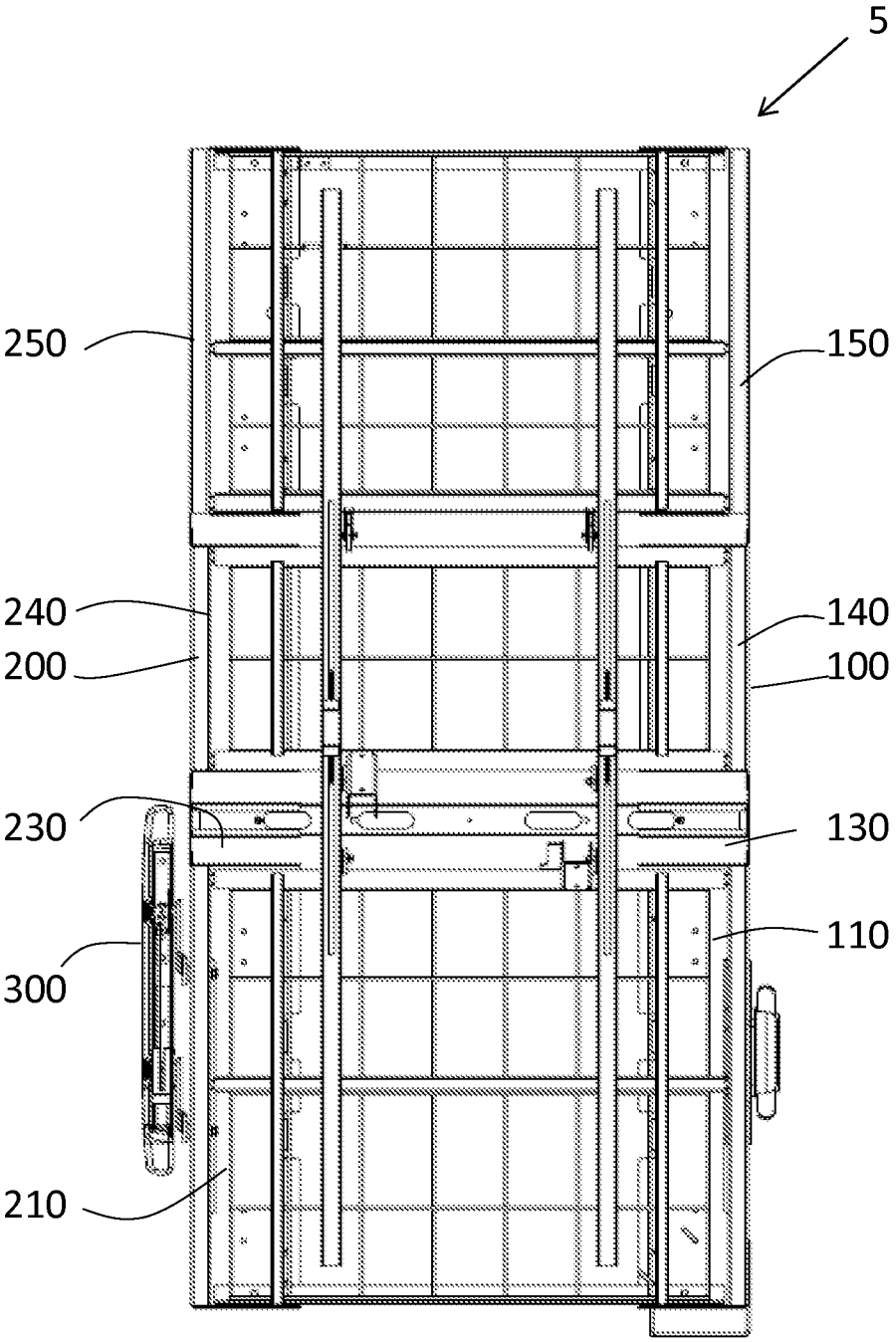
FIG. 8 is a bottom view of the extensions shown in a retracted position.
Figure 9:
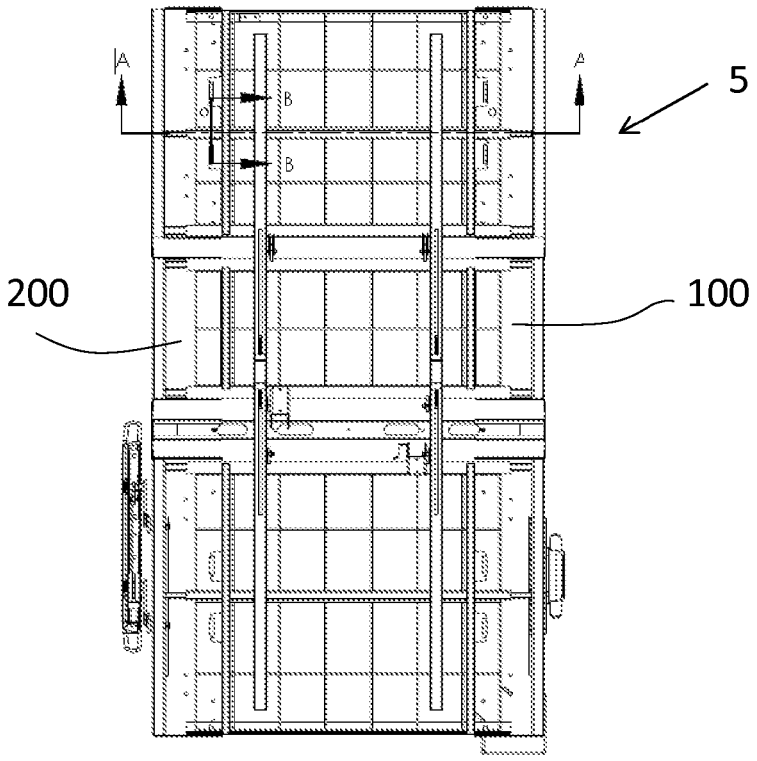
FIG. 9 is similar to FIG. 5 but shows the extensions in an intermediate position.
Figure 10:
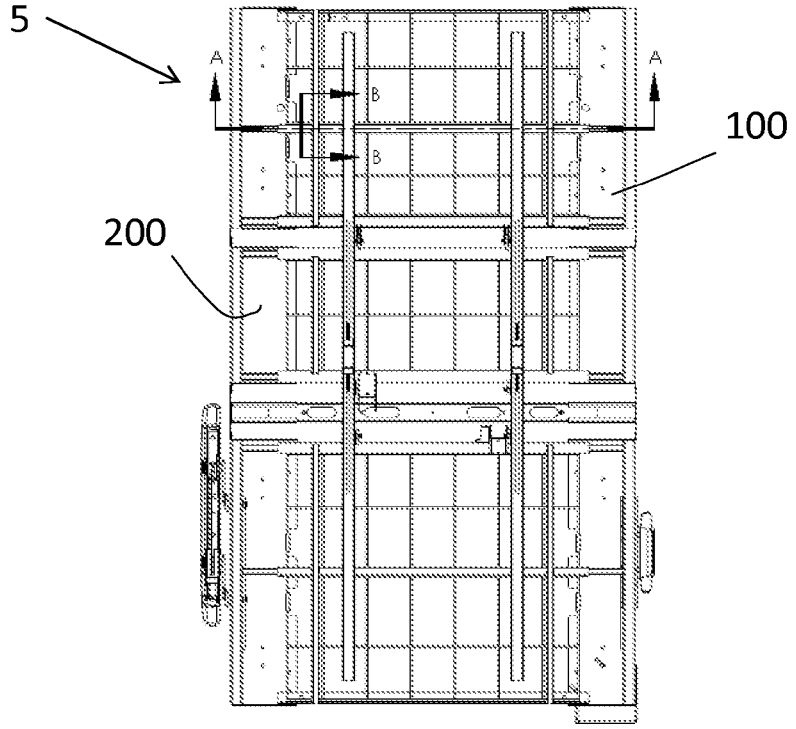
FIG. 10 is similar to FIG. 5 but shows the extensions in an expanded position.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Turning now to FIGS. 1-14, it is seen that a preferred embodiment of the present invention is illustrated.

As can be seen, an articulating bed 5 having sides 6 and 7, ends 8 and 9, a head board 11 and a foot board 12 is shown. A deck 20 having four sections 30, 40, 50 and 60 is also provided.

The first section 30 has a perimeter frame 31. The perimeter frame can be made of angle material having a vertical section and horizontal section. A cross tube 32 is provided. The cross tube 32 has an inside 33 and an outside. It further has a top 34 and a bottom 35. Cross tube preferably extends laterally across the first section 30 and has ends 36 and 37 and a middle section 38. In the preferred embodiment, the cross tube 32 can have a generally square shaped profile. Yet, it is understood that other profiles could be used without departing from the broad aspects of the present invention.

The second section 40 does not articulate. It has sides that are parallel with the sides of the other sections.

The third section 50 has a perimeter frame similar to the frame of the first section.

The fourth section 60 likewise has a perimeter frame 61. It also has a cross tube 62.

Cross tube 32 and cross tube 62 are spaced apart a predetermined amount. It is understood that while the cross tubes are shown in relation to the first and fourth sections, that they could be located elsewhere without departing from the broad aspects of the present invention.

Two side extensions 100 and 200 are illustrated. In the preferred embodiment, the side extensions move independent of each other. Yet, it is understood that they could be joined in a manner wherein they are simultaneously expanded and retracted relative the deck 20.

Side extension 100 has four pieces 110, 130, 140 and 150. Each piece preferably has the same lateral width. The side extension has a top 101, a bottom 102, and inside 103 and outside 104 and opposed ends 105 and 106, respectively. The top 101 is preferably substantially planar.

The first piece 110 has a side tube 111 that is preferably made of square tubing. A tab 112 is at one end of the tubing. The tab 112 is preferably formed from the outer side wall of the square tubing, wherein the top, bottom and inside side wall are removed. Tab 112, as seen in an isolation view in FIG. 13, has a connection hole there through.

An extension member 120 is provided. The extension member 120 has a first end 121 and a second end 122. The second end 122 can extend to the middle 38 (or near the middle) of the cross tube when the side extension 100 is in the retracted position. The extension member can be formed of square tubing that is received within the inside of the cross tube. A glide 125 can be provided. The glide can be a low friction material that slide, or can comprise rollers or other structures that facilitate movement of the extension member within the cross tube. A connector such as a pin 127 can be provided for fixing the extension member within the cross-tube. Three holes 126 can be formed through the extension member enabling retracted, intermediate and extended positions. The extension member 120 (either directly or through an intermediate component such as a glide) can contact the inside of the cross tube a substantial distance inside of the end of the cross-tube. This prevents up/down as well as forward/rearward twisting of the side extension.

The pin also allows the side extension to be in either of the retracted, intermediate or extended position.

The second piece 130 has a side tube 131 with two end tabs 132 and 133.

The third piece 140 has a side tube 141 with two end tabs 142 and 143.

The fourth piece has a side tube 151 with one end tab 152. The fourth piece also has an extension member 155 that is movably received in telescopic fashion with cross tube 62.

Figure 11:
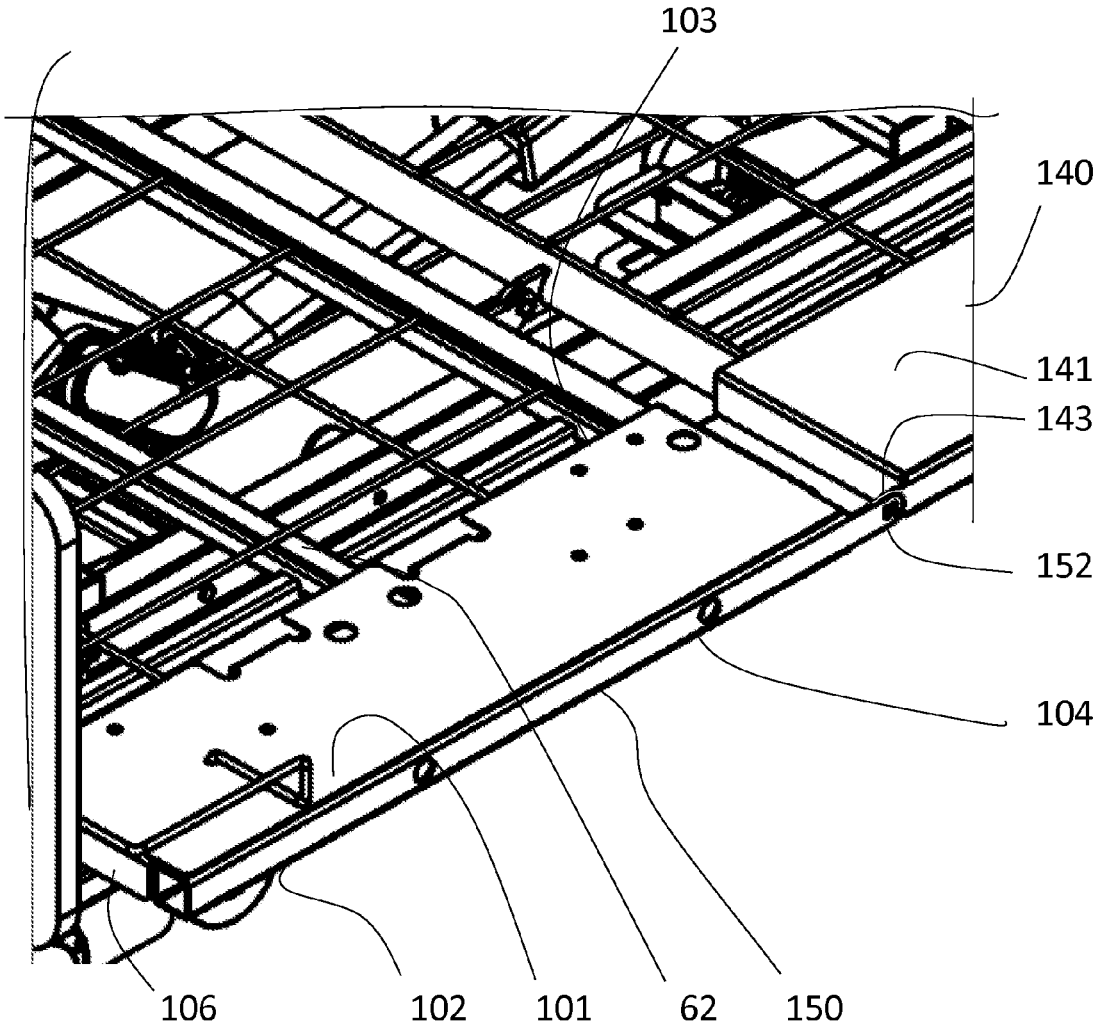
FIG. 11 is a close-up perspective view showing the fourth piece of an extension.
Figure 12:
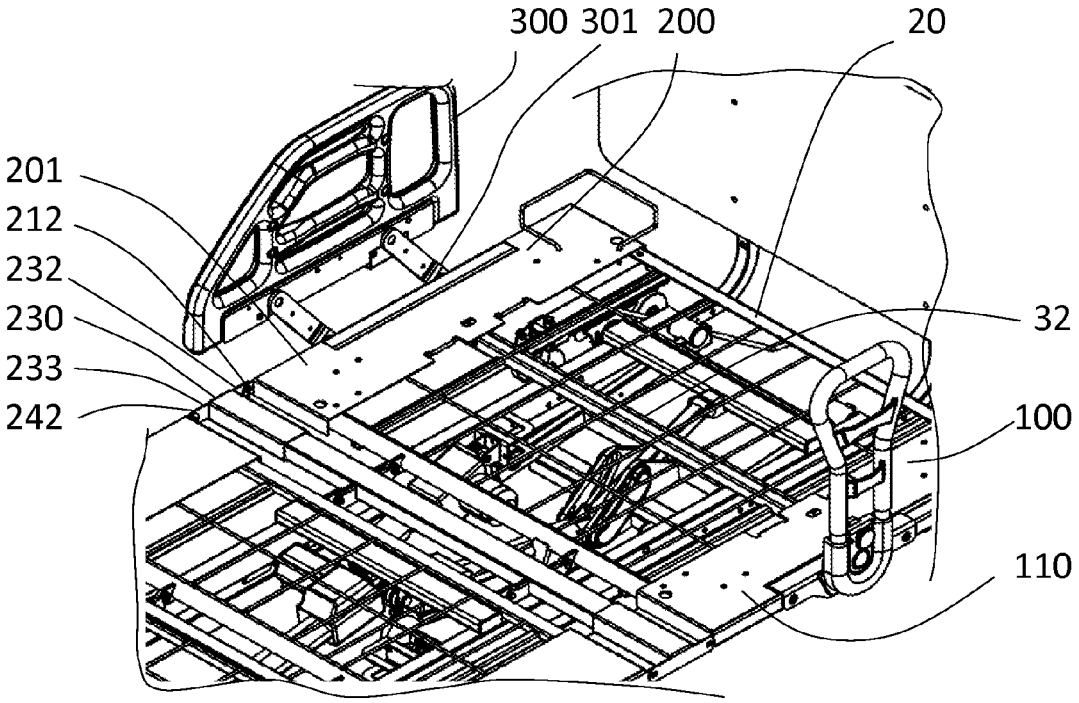
FIG. 12 is a close-up perspective view showing accessories removably pinned to the extension members.
Figure 13:
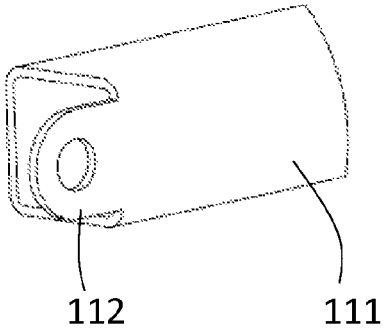
FIG. 13 is an isolation view showing the tab of a side tube.
Figure 14:
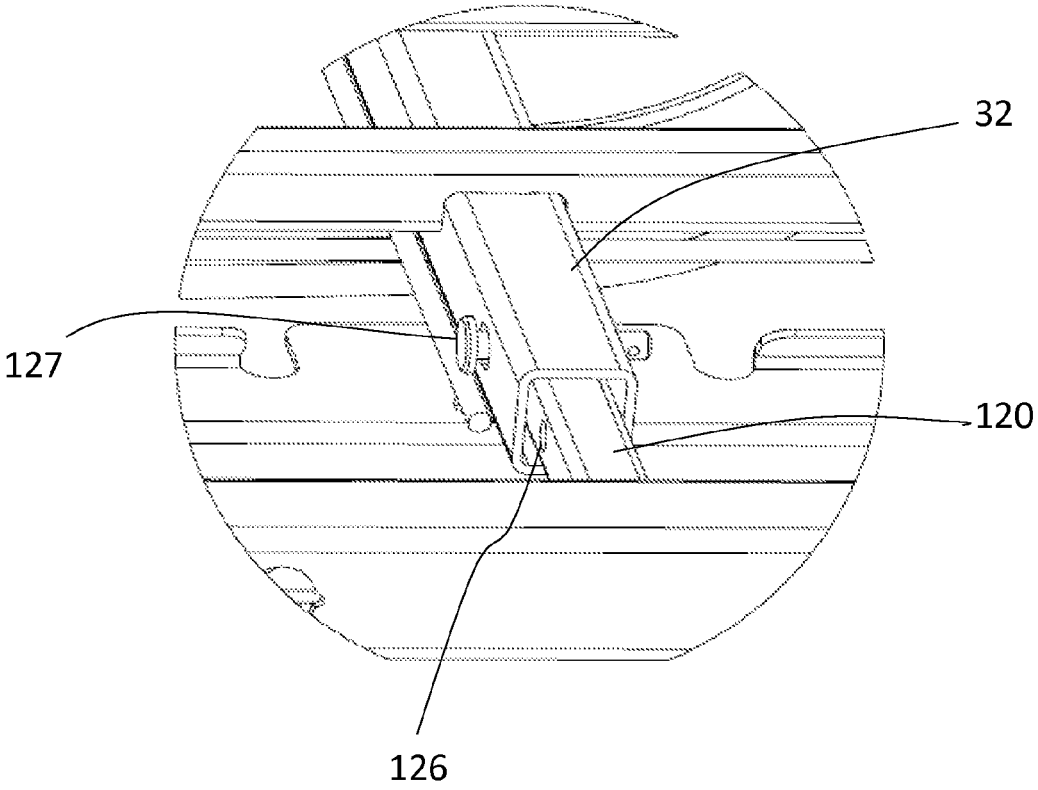
FIG. 14 is a close-up perspective view showing the extension member pinned to the cross-member.

It is seen that the pieces are pivotally connected to adjacent pieces by bolting or otherwise connecting the pieces via the respective tabs. In this regard, the pivotal connections are strong and secure, and are also located at the outside 104 of the side extension 100. As seen in FIG. 11, overlapped tabs 143 and 152 are pivotally joined.

Tab 112 is preferably overlapped with and connected to tab 132. Tab 133 is preferably overlapped with and connected to tab 142. Tab 143 is preferably overlapped with and connected to tab 152. These pivotal connections allow the extension 100 to articulate relative each other and to move uniformly between retracted, intermediate and extended positions.

Further, given that the extension members are received within cross tubes interior of the ends of the cross tubes to promote movement of the side extension perpendicular to the deck side, binding of the side extension is prevented.

The second side extension 200 is preferably a mirror image of the first side extension 100. Side extension 200 has four pieces 210, 230, 240 and 250. Each piece preferably has the same lateral width. The side extension has a top 201, a bottom 202, and inside 203 and outside 204 and opposed ends 205 and 206, respectively. The top 201 is preferably substantially planar.

The first piece 210 has a side tube 211 that is preferably made of square tubing. A tab 212 is at one end of the tubing. The tab 212 is preferably formed from the outer side wall of the square tubing, wherein the top, bottom and inside side wall are removed. An extension member 220 is provided. The extension member 220 has a first end 221 and a second end 222. The second end 222 can extend to the middle 38 (or near the middle) of the cross tube when the side extension 200 is in the retracted position. Three holes 226 can be formed through the extension member enabling retracted, intermediate and extended positions. The extension member can be formed of square tubing that is received within the inside of the cross tube. A glide can be provided. The glide can be a low friction material that slide, or can comprise rollers or other structures that facilitate movement of the extension member within the cross tube. A connector such as a pin can be provided for fixing the extension member within the cross-tube in one of the three holes 226.

The second piece 230 has a side tube 231 with two end tabs 232 and 233.

The third piece 240 has a side tube 241 with two end tabs 242 and 243.

The fourth piece has a side tube 251 with one end tab 252. The fourth piece also has an extension member 255 that is movably received in telescopic fashion with cross tube 62.

It is seen that the pieces are pivotally connected to adjacent pieces by bolting or otherwise connecting the pieces via the respective tabs. In this regard, the pivotal connections are strong and secure, and are also located at the outside 204 of the side extension 200.

Tab 212 is preferably overlapped with and connected to tab 232. Tab 233 is preferably overlapped with and connected to tab 242. Tab 243 is preferably overlapped with and connected to tab 252. These pivotal connections allow the extension 200 to articulate relative each other and to move uniformly between retracted, intermediate and extended positions.

The bed 5 can have a width of approximately 36 inches when the side extensions are both in the retracted position, approximately 39 inches when in the intermediate position and approximately 42 inches when in the extended position. It is understood that the lateral dimension could be changed without departing from the broad aspect of the present invention. Also there could be more intermediate positions or no intermediate position without departing from the broad aspects of the present invention.

An accessory such as a side rail 300 can be provided. The side rail 300 can be pinned with pins 301 such that it is removably attached to the outside of either side extension. The substantially tubular perimeter of each side extension provides a strong base for the accessories to be connected to.

It is further appreciated that each side extension can have more or fewer than four pieces without departing from the broad aspects of the present invention.

The pin 127 also allows the side extension to be in either of the retracted, intermediate or extended position by being selectably inserted into selected holes that pass through the extension members. It is appreciated that two pins hold each side section in place (four pins total) in a preferred embodiment. Yet, it is appreciated that other connection or fastening devices may be used without departing from the broad aspects of the present invention. It is also understood that more or fewer positions could be present without departing from the broad aspects of the present invention.

Thus it is apparent that there has been provided, in accordance with the invention, a bed with extendable and retractable sections that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A bed comprising:

a deck with a bed first section and a bed second section, said deck being a mattress support surface and having a deck plane;

a first side extension connected to said deck, said first side extension comprising:

a first piece with an extension member and a first piece wall that is part of a first square tube; and a second piece with a second piece wall, wherein said first piece wall and said second piece wall are directly connected together whereby said first piece and said second piece act in unison; and a second side extension connected to said deck and opposite of said first side extension, said first side extension being extendable from said deck in an opposite linear direction compared to said second side extension.

2. The bed of claim 1 wherein:

said first piece is pivotally connected to said second piece; and said deck is an articulating deck and said first piece and said second piece move in unison parallel to said deck plane regardless of an angular orientation of said first piece with respect to said second piece.

3. The bed of claim 1 wherein:

said deck further comprises a bed third section and a bed fourth section; and said first side extension further comprises a third piece and a fourth piece.

4. The bed of claim 1 wherein:

said first piece comprises a first piece tab formed as a part of said first piece wall; and said second piece comprises a second piece tab formed as a part of said second piece wall, said first piece tab being connected to said second piece tab.

5. The bed of claim 1 wherein:

said bed first section comprises a cross tube laterally oriented across said bed first section; and said extension member is received within said cross tube.

6. The bed of claim 5 wherein said extension member has a generally square profile.

7. The bed of claim 5 wherein a glide is provided to facilitate movement of said extension member within said cross tube.

8. The bed of claim 5 wherein a cross tube hole is provided through said cross tube for receiving a pin to lock said extension member in position relative to said cross tube.

9. The bed of claim 8 wherein said extension member comprises a first extension member hole, a second extension member hole and a third extension member hole for individually receiving said pin, said first extension member hole defining a narrow position of said bed, said second extension member hole defining an intermediate position of said bed and said third extension member hole defining a wide position of said bed.

10. A bed comprising:

a deck with a mattress support surface for primarily supporting a mattress by supporting at least a central portion of the mattress, said deck having a bed first section and a bed second section, said bed first section comprising a cross tube with a cross tube longitudinal axis and being laterally oriented relative to said bed first section, said bed first section being angularly movable relative to said bed second section to a selected angle;

a first side extension connected to said deck, said first side extension comprising:

a first piece with an extension member having an extension member longitudinal axis, said extension member being movable within said cross tube in a direction wherein said extension member longitudinal axis is generally parallel with said cross tube longitudinal axis; and a second piece, said second piece being pivotally connected to said first piece;

a second side extension connected to said deck and opposite of said first side extension; and a fastener selectably holding said first side extension in place relative to said deck, wherein said first piece and said second piece are manually movable laterally relative to said deck when said fastener is unfastened and said first piece and said second piece are unmovable relative to said deck when said fastener is fastened, wherein movement of said first piece and said second piece relative to said deck occurs regardless of said selected angle between said bed first section and said bed second section movement of said first side extension is independent of movement of said second side extension, and said first side extension is expandable in an opposite linear direction compared to said second side extension.

11. The bed of claim 10 wherein said extension member has a generally square profile.

12. The bed of claim 10 wherein a glide is provided to facilitate movement of said extension member within said cross tube.

13. The bed of claim 10 wherein:

said deck further comprises a bed third section and a bed fourth section; and said first side extension further comprises a third piece and a fourth piece.

14. The bed of claim 10 wherein:

said first piece has a side tube with an outer side wall, and a first piece tab is formed from said outer side wall; and said second piece comprises a second piece tab, said first piece tab being connected to said second piece tab.

15. The bed of claim 10 wherein:

said fastener is a pin;

a cross tube hole is provided through said cross tube for receiving said pin to lock said extension member in position relative to said cross tube; and said extension member comprises a first extension member hole, a second extension member hole and a third extension member hole for individually receiving said pin, said first extension member hole defining a narrow position of said bed, said second extension member hole defining an intermediate position of said bed and said third extension member hole defining a wide position of said bed.

16. A bed comprising:

a deck with a bed first section, a bed second section, a bed third section and a bed fourth section, said bed first section comprising a cross tube laterally oriented within said bed first section, and said deck having a mattress support surface and being an articulating deck;

a first side extension connected to said deck, said first side extension comprising:

a first piece with an extension member movable within said cross tube;

a second piece, said second piece being pivotally connected to said first piece;

a third piece, said third piece being pivotally connected to said second piece; and a fourth piece, said fourth piece being pivotally connected to said third piece; and a second side extension comprising a plurality of second side extension pieces;

wherein said first side extension moves linearly and in unison relative to said deck and said second side extension moves linearly and in unison relative to said deck regardless of an angular orientation between said bed first section, said bed second section, said bed third section and said bed fourth section.

17. The bed of claim 16 wherein:

said cross tube is a generally square cross tube; and said first piece has a glide on said extension member.

18. The bed of claim 16 where said fourth piece has a fourth piece extension member, said fourth piece extension member being parallel to said extension member of said first piece and being operable laterally relative to said deck.

19. The bed of claim 16 wherein movement of said first side extension is independent of movement of said second side extension.

20. A bed comprising:

a deck with a bed first section and a bed second section;

a side extension connected to said deck, said side extension comprising:

a first piece with an extension member and a first piece wall; and a second piece with a second piece wall, wherein:

said first piece wall and said second piece wall are connected together whereby said first piece and said second piece act in unison;

said bed first section comprises a cross tube;

said extension member is received within cross tube; and a cross tube hole is provided through said cross tube for receiving a pin to lock said extension member in position relative to said cross tube.

21. The bed of claim 20 wherein said extension member comprises a first extension member hole, a second extension member hole and a third extension member hole for individually receiving said pin, said first extension member hole defining a narrow position of said bed, said second extension member hole defining an intermediate position of said bed and said third extension member hole defining a wide position of said bed.

22. A bed comprising:

a deck with a bed first section and a bed second section, said bed first section comprising a cross tube;

a first side extension connected to said deck, said first side extension comprising:

a first piece with an extension member movable within said cross tube; and a second piece, said second piece being pivotally connected to said first piece; and a fastener selectably holding said first side extension in place relative to said deck, wherein:

said first piece and said second piece are manually movable relative to said deck when said fastener is unfastened and said first piece and said second piece are unmovable relative to said deck when said fastener is fastened;

said fastener is a pin;

a cross tube hole is provided through said cross tube for receiving said pin to lock said extension member in position relative to said cross tube; and said extension member comprises a first extension member hole, a second extension member hole and a third extension member hole for individually receiving said pin, said first extension member hole defining a narrow position of said bed, said second extension member hole defining an intermediate position of said bed and said third extension member hole defining a wide position of said bed.

23. A bed comprising:

a deck with a bed first section and a bed second section, said bed first section comprising a cross tube laterally oriented across said bed first section, said deck having a deck plane within said bed first section and said cross tube having a cross tube surface that is generally perpendicular to said deck plane;

a first side extension connected to said deck, said first side extension comprising:

a first piece with an extension member and a first piece wall, said extension member having an extension member surface that is generally perpendicular to said deck plane and being received within said cross tube; and a second piece with a second piece wall, wherein said first piece wall and said second piece wall are connected together whereby said first piece and said second piece act in unison, and a second side extension connected to said deck and opposite of said first side extension, said first side extension being extendable from said deck in an opposite linear direction compared to said second side extension.

* * * * *